United States Patent [19]

Gryctko et al.

[11] 4,144,427

[45] Mar. 13, 1979

[54] ANTI-REBOUND AND CONTACT KICKER MEANS FOR CIRCUIT BREAKER

[75] Inventors: Carl E. Gryctko, Zanesfield; Andrew J. Kralik, Marysville, both of Ohio

[73] Assignee: Gould Inc., Rolling Meadows, Ill.

[21] Appl. No.: 817,355

[22] Filed: Jul. 20, 1977

[51] Int. Cl.[2] ..... H01H 3/46

[52] U.S. Cl. ..... 200/153 G; 200/153 H; 200/153 SC; 337/345

[58] Field of Search ..... 200/153 G, 153 H, 153 SC, 200/154; 335/168, 189; 337/85, 86, 87, 335, 345

[56] References Cited

U.S. PATENT DOCUMENTS

| | | | |
|---|---|---|---|
| 3,003,046 | 10/1961 | Torre | 200/153 G |
| 3,134,879 | 5/1964 | Gauthier et al. | 200/153 G |
| 3,158,716 | 11/1964 | Koval | 200/153 G |
| 3,293,397 | 12/1966 | Zubaty et al. | 200/153 G |
| 3,508,178 | 4/1970 | Chabala et al. | 200/153 G |
| 3,783,215 | 1/1974 | Brumfield | 200/153 G |
| 3,805,199 | 4/1974 | Tazuki | 200/153 G |
| 3,849,751 | 11/1974 | Link et al. | 200/153 G |
| 4,001,742 | 1/1977 | Jencks et al. | 200/153 G |

*Primary Examiner*—William Price
*Assistant Examiner*—Joseph M. Moy
*Attorney, Agent, or Firm*—Ostrolenk, Faber, Gerb & Soffen

[57] ABSTRACT

A single pole molded case circuit breaker having a spring powered trip free contact operating mechanism including an extendable toggle connected at one end to a releasable cradle and connected at the other end to a movable contact, a latch for holding the cradle in reset position, and an automatic trip means for operating the latch to release the cradle upon the occurrence of predetermined overload conditions, is provided with anti-rebound means which prevents the movable contact from moving toward closed circuit position except under the influence of the operating mechanism. The anti-rebound means includes engaging formations of the cradle and toggle which cooperate to block the toggle from being extended unless the cradle is in its reset position. As the cradle moves to trip position it engages the toggle to kick the contact arm toward open position.

13 Claims, 21 Drawing Figures

50
50a
50b
50c
50d
52
55
62
83
5A
5B
201
202
47
47a
47b
47c
51
57
64
94
97
56

ANTI-REBOUND AND CONTACT KICKER MEANS FOR CIRCUIT BREAKER

This invention relates to an improvement of the circuit breaker disclosed in the T. J. Rys copending application Ser. No. 703,078 filed July 6, 1976 for a Mounting Plate For Molded Case Circuit Breaker, now U.S. Pat. No. 4,079,346, issued Mar. 14, 1978, and more particularly relates to means for preventing contact rebound toward closed position and for kicking the contact arm during automatic tripping.

Circuit breakers are often provided with anti-rebound means which prevent the movable contact from moving toward closed circuit position unless moved in this direction by the contact operating mechanism. Contact rebound is especially troublesome when very high fault currents are being interrupted in that rebound may result in reignition of the arc.

Typical prior art anti-rebound means include hooks, springpins, hook pivot pins, biasing springs, latch reset cams, as well as other elements. All in all, prior art arrangements of this type have been excessively bulky and/or of complex construction thereby increasing the possibility of potential malfunction.

Pursuant to the instant invention an anti-rebound latch consists of a formation on the cradle which engages one of the toggle links to lock extension of the toggle unless the releasable cradle is in reset position. Resetting of the cradle after tripping repositions this formation on the cradle to permit the toggle to be extended without interference by the cradle. When tripped the cradle engages the toggle to kick the contact arm open.

Accordingly, a primary object of the instant invention is to provide a novel anti-rebound latch means and contact arm kicker means for a circuit breaker.

Another object is to provide an anti-rebound latch means of this type that is of low cost.

Still another object is to provide an anti-rebound latch means of this type which is extremely compact.

A further object is to provide an anti-bound latch means of this type which directly engages a collapsible toggle to prevent the latter from being extended toward contact closed position unless the toggle operating mechanism is in reset position.

These objects as well as other objects of this invention shall become readily apparent after reading the following description of the accompanying drawings in which.

Figure 9A:
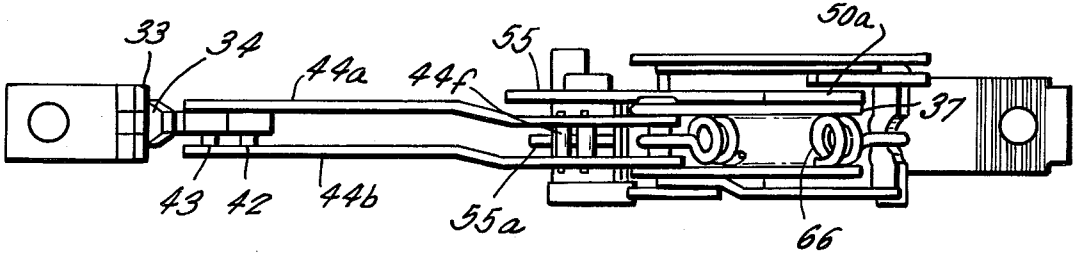
FIG. 9A is a plan view of the elements of FIG. 9.
Figure 9:
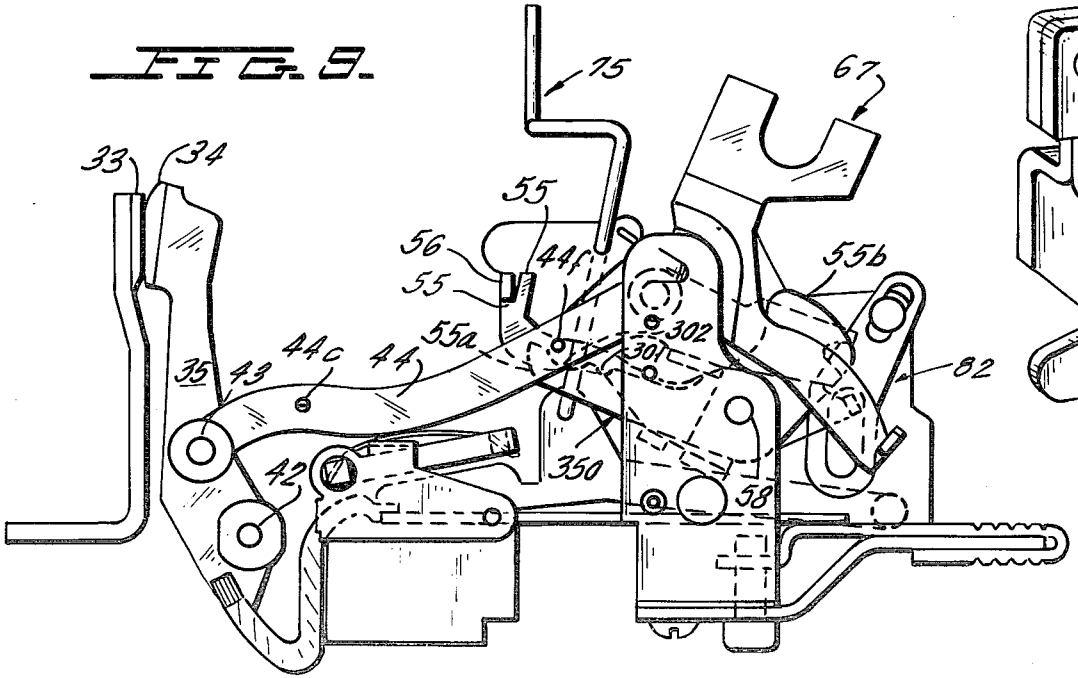
FIG. 9 is a view similar to FIG. 1 but showing only those elements necessary to explain a second embodiment of anti-rebound means constructed in accordance with teachings of the instant invention.
Figure 10:
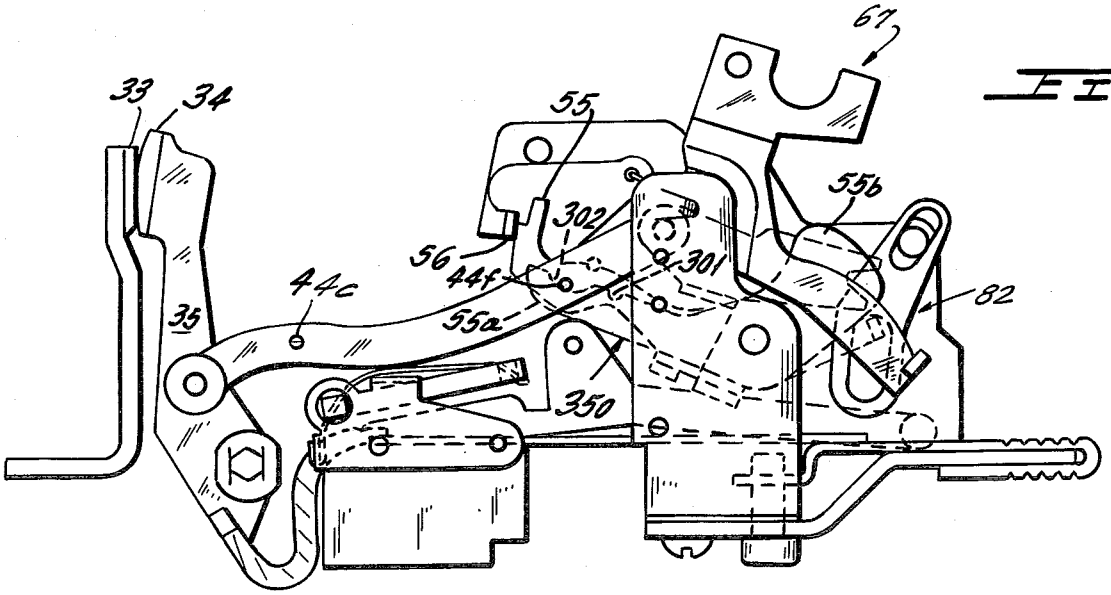
Figure 11:
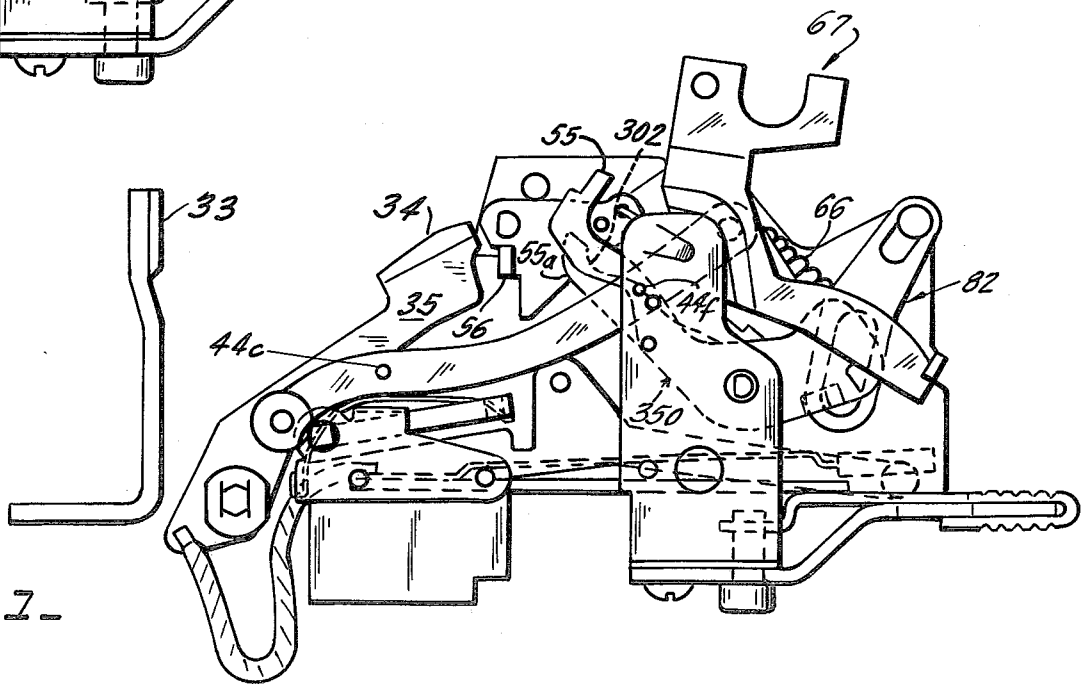

FIGS. 10 and 11 are views similar to FIG. 9. In FIG. 10 the contacts are still closed but the cradle has begun movement toward its tripped position. In FIG. 11 the cradle is in its fully tripped position and the movable contact arm is in full open circuit position.

Figure 12:
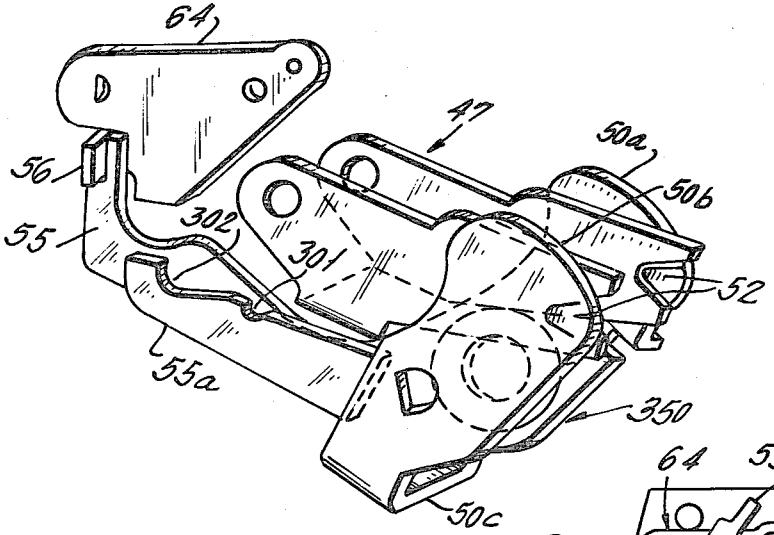

FIG. 12 is a perspective showing the cradle of the embodiment of FIG. 9 in relation to the latch and one of the toggle links.

Figure 1:
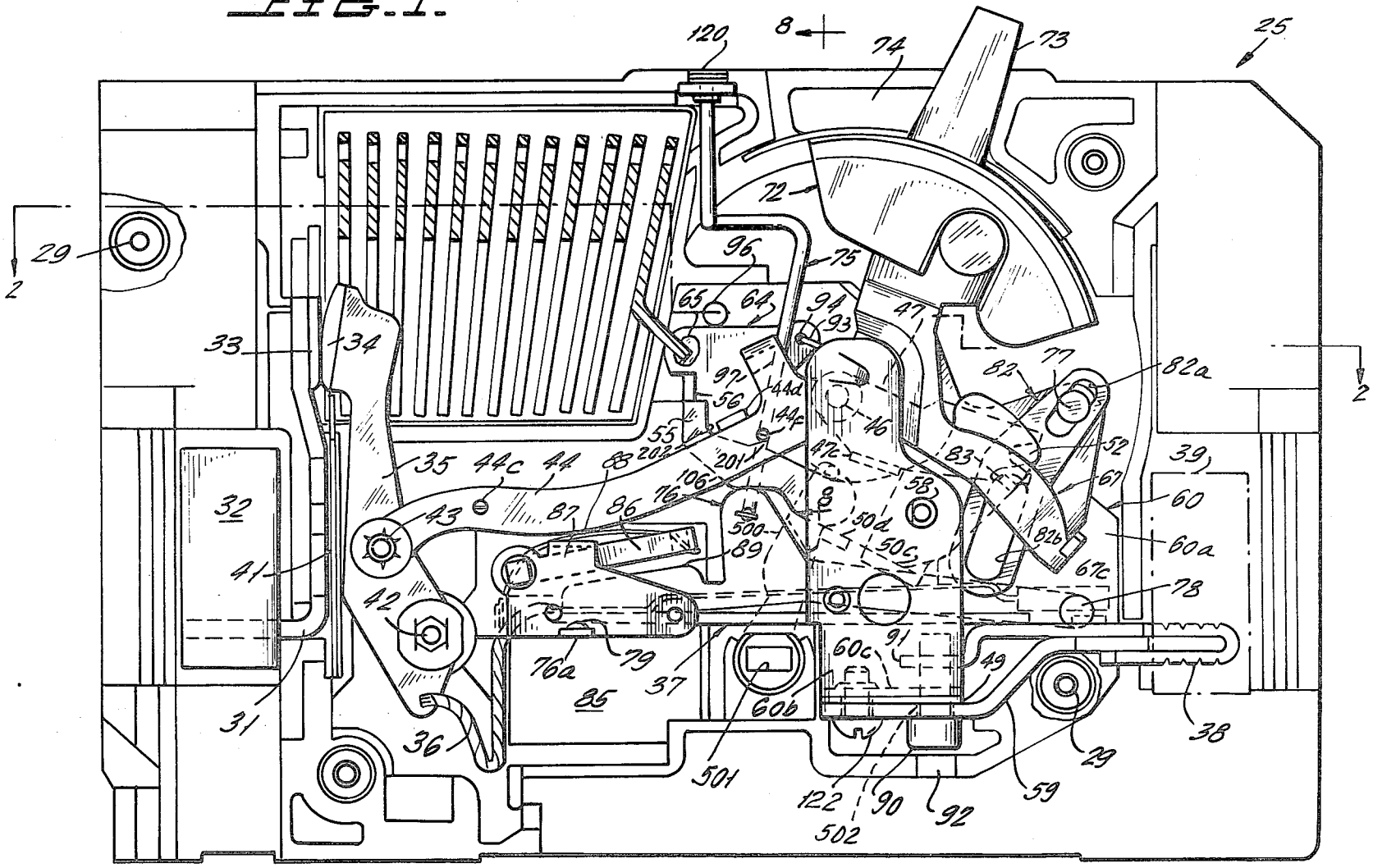
FIG. 1 is a side elevation of a single pole circuit breaker constructed in accordance with the instant invention with the contacts closed and the near housing half removed to reveal the operating elements.
Figure 2:
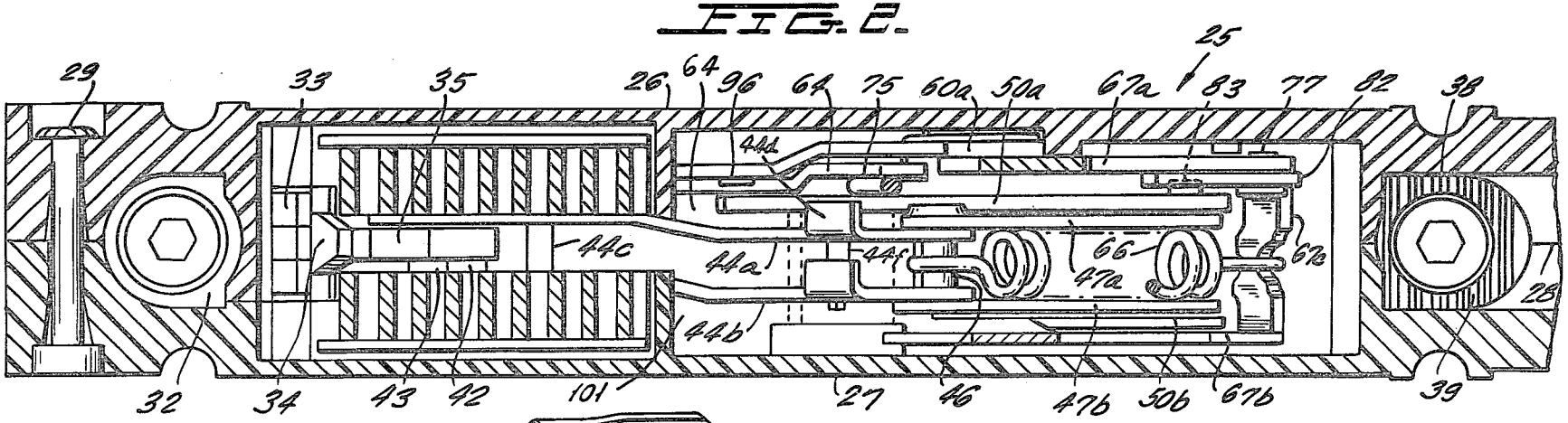
FIG. 2 is a longitudinal cross-section taken through line 2—2 of FIG. 1 looking in the direction of arrows 2—2.
Figure 6:
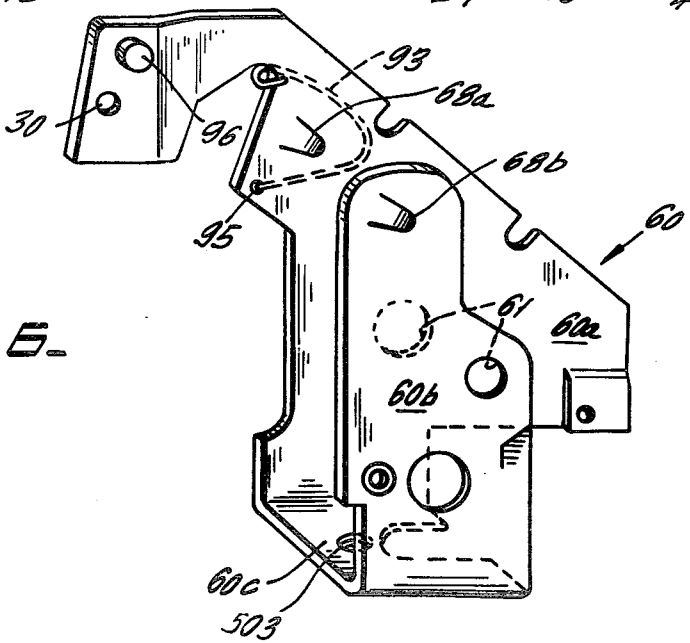
FIG. 6 is a perspective of the mounting plate for the contact operating mechanism.
Figure 13:
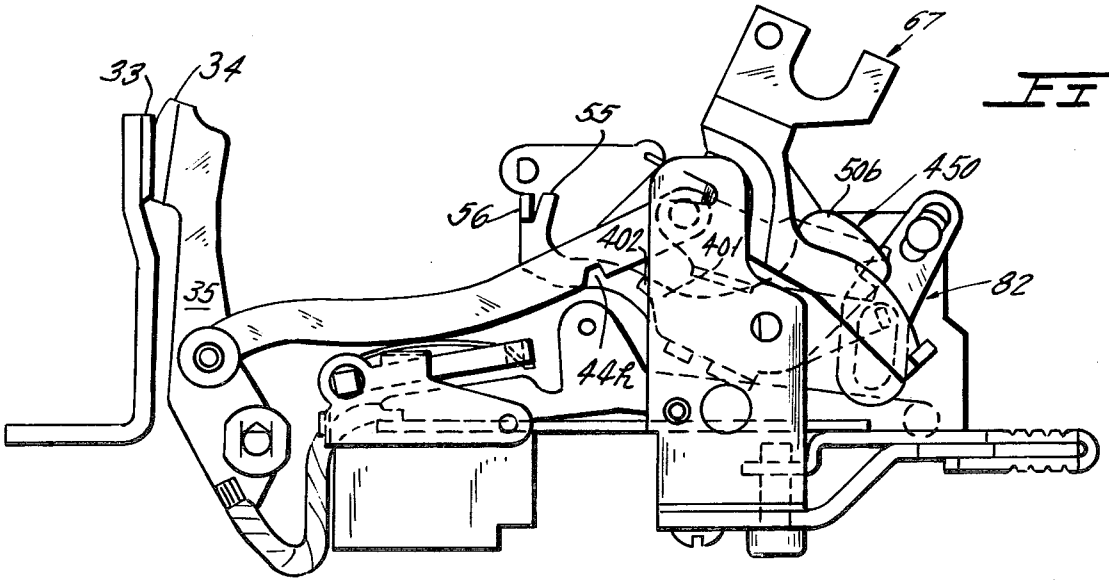

FIG. 13 is a view similar to FIG. 1 but showing only those elements necessary to explain a third embodiment of anti-rebound means constructed in accordance with teachings of the instant invention.

Figure 15:
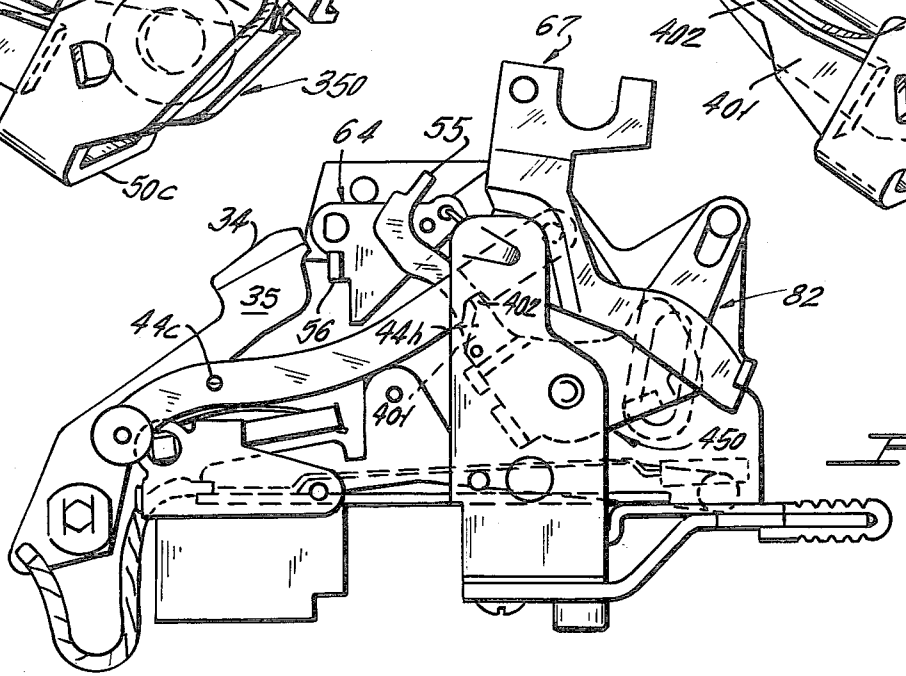
Figure 14:
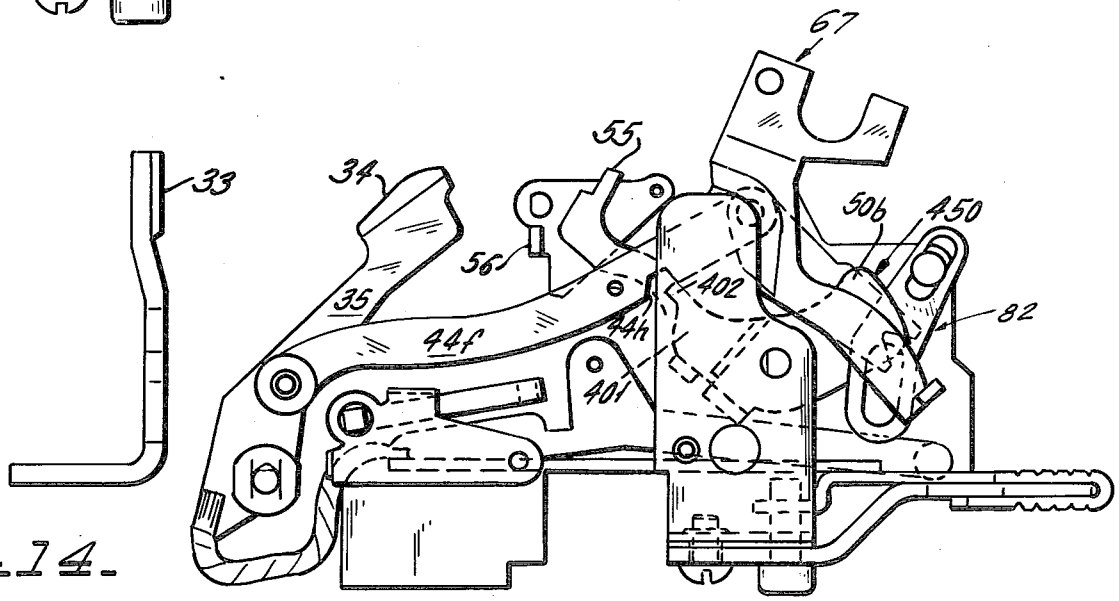

FIGS. 14 and 15 are views similar to FIG. 13. In FIG. 14 the movable contact is nearly at its full open position and the cradle is near its fully tripped position. In FIG. 15 the cradle is in its fully tripped position and the movable contact arm is in its full open circuit position.

Figure 16:
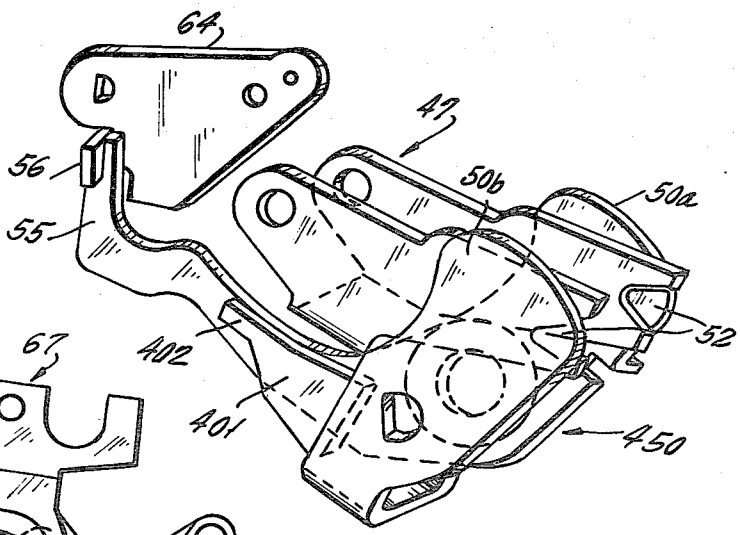

FIG. 16 is a perspective showing the cradle of the embodiment of FIG. 13 in relation to the latch and one of the toggle links.

Now referring to the Figures and more particularly to FIGS. 1 through 8. Circuit breaker pole unit 25 is provided with a molded insulating housing consisting of sections 26, 27 which mate at line 28 (FIG. 2) and are secured together by rivets 29. The current carrying path through circuit breaker 25 extends from wire grip 32 at one end of load terminal strap 31 to stationary contact 33 to movable contact 34 at the other end of movable contact arm 35, through contact arm 35 and dual braid 36 connected to the other end of arm 35, through bimetal 37 to line terminal member 38 having wire grip 39 mounted thereon.

Thin insulating sheet 41 is interposed between movable contact arm 35 and load terminal strap 31 to electrically insulate these elements for a major portion of the length of contact arm 35. However, these elements are so close to one another that current limiting through contact blow-off is achieved by interaction of magnetic fields which accompany current flow in strap 31 and arm 35.

Figures 5, 5A, 5B, 5C:
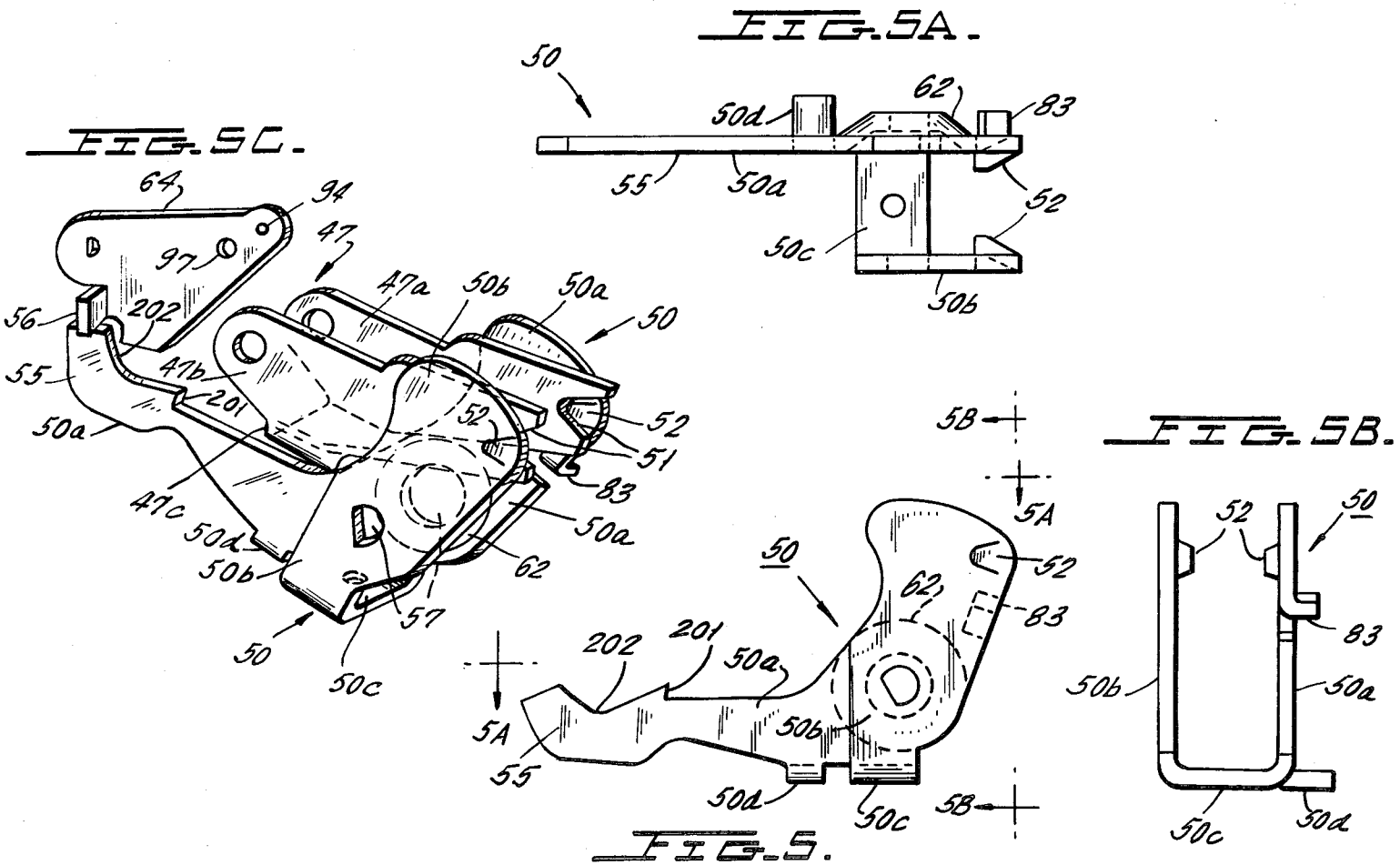
FIG. 5 is a side elevation of the releasable cradle of the contact operating mechanism.
FIGS. 5A and 5B are elevations of the cradle looking in the directions of the respective arrows 5A—5A and 5B—5B of FIG. 5.
FIG. 5C is a perspective showing the cradle and one of the toggle links pivotally connected thereto.

The lower end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Link 44 consists of two identical parallel arms 44*a*, 44*b* maintained spaced apart approximately the thickness of contact arm 35 by two spacers 44*c*, 44*b*. As seen in FIG. 5, toggle link 47 is a bifurcated element having parallel sections 47*a*, 47*b* joined by web 47*c*. Sections 47*a*, 47*b* are each provided with a V-notch 51 which receives a boss 52 on the inner surface of parallel walls 50, 50*b* of cradle 50. Walls 50*a*, 50*b* are joined by web 50*c* and wall 50*a* is provided with latching tip extension 55 engageable by latching protrusion 56 of latch member 64. Ear 50*d* extends outward from wall 50*a* and engages an edge of pivoted interphase trip lever 500 near the end thereof remote from rectangular aperture 501. A tie bar (not shown) extends through aperture 501 when pole unit 25 is part of a multipole assembly having interphase tripping. Extension 55 is engageable with sideways protrusion 44*d* (FIG. 4) of toggle arm 44*a* to act as a kicker for separation of contacts 33, 34 should they tend to weld or otherwise stick closed during fault conditions.

Aligned apertures 57 in walls 50*a*, 50*b* receive pin 58 which pivotally mounts cradle 50 to formed mounting plate or frame 60 (FIG. 6) at aligned apertures in main and auxiliary walls 60*a*, 60*b* of plate 60. Web section 60*c* connects walls 60*a*, 60*b* in spaced parallel relationship. Insulating screw 122 (FIG. 1) extends through a clearance aperture 502 in support strap 59 and is received by threaded aperture 503 is web 60*c* to secure mounting plate 60 to strap 59 with thin insulation 49 interposed therebetween. Embossment 62 of cradle 50 provides a narrow space between latching tip 55 and frame wall 60*a* for clearing the main planar portion of latch member 64. The latter is mounted on plate 60 by cantilevered pivot pin 65 at aperture 30 of wall 60*a*. Cantilevered latching protrusion 56 extends perpendicular to the main planar portion of member 64. V-shaped wire spring 93 (FIG. 6), positioned against the outer surface of plate wall 60*a*, has its end extending into aperture 94 in latch 64 and aperture 95 in wall 60*a* to bias latch 64 counterclockwise with respect to FIG. 1 against inward protrusion 96 of wall 60*a*.

Figure 7:
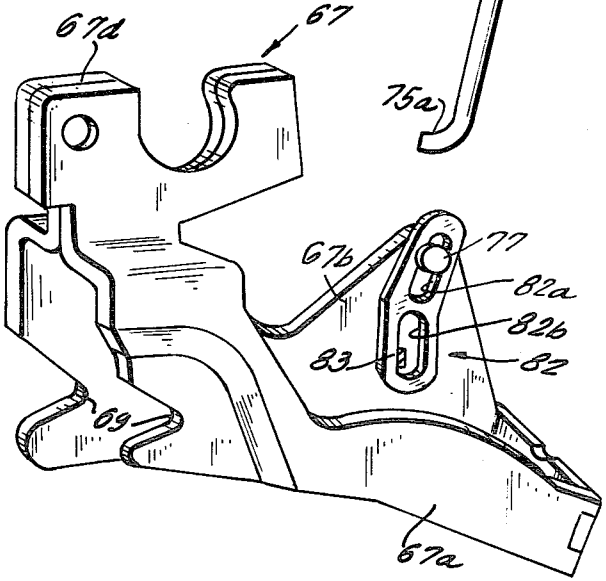
FIG. 7 is a perspective of the mechanism operating member and reset link assembled thereto.

Main operating spring 66 (FIG. 2) is a coiled tension member connected at one of its ends to toggle knee pin 46 and at the other of its ends to operating member 67 at connecting section 67*c* between spaced main walls of operating member sections 67*a*, 67*b* (FIG. 7). The upper ends of the respective sections 67*a*, 67*b* are offset inwardly to abut one another and are secured together to constitute extension 67*d*. Member 67 is pivotally mounted between walls 60*a*, 60*b* of mounting member 60 at inward bearing projections 68*a*, 68*b* which extend into aligned V-notches 69 in walls 67*a*, 67*b* of member 67. Upper extension 67*d* of operating member 67 extends into a complementary recess in the lower surface of handle member 72. The latter includes extension or handle 73 which projects through housing opening 74 so that handle 73 is engageable for manual operation of circuit breaker 25.

Formed wire link 75 connects latch member 64 at aperture 97 thereof to trip member 76 at a point intermediate the ends of the latter. Member 76 is pivotally mounted at one of its ends to mounting member 60 by pin 78.

As seen in FIG. 1, the right end of the bimetal 37 is fixedly secured to line terminal member 38 and the free end of bimetal 37 is aligned with trip member protrusion 79. Upon heating of bimetal 37 due to abnormal current conditions existing for an extended period of time, the free end of bimetal 37 deflects and engages protrusion 79 on ear 76*a* projecting perpendicular to the main portion of trip member 76. This pivots trip member 76 counterclockwise with respect to FIG. 1 and moves link 75 downward to pivot latch member 64 clockwise, whereby latch 56 releases cradle tip 55. Now, under the influence of main operating spring 66 cradle 50 pivots clockwise and moves pivots 52 at the right end of toggle 44, 47 below the line of action of spring 66 so that the latter is effective to move toggle knee 46 rapidly to the right with respect to FIG. 1 causing contact arm 35 to pivot clockwise and separate movable contact 34 from stationary contact 33.

Calibrating screw 90, passing through a clearance aperture in strap 59 and threadably engaged with offset 91 of terminal member 38, is accessible for operation at housing aperture 92. By rotating screw 90 member 38 is bent thereby repositioning the free end of bimetal 37 to set the thermal trip calibration by adjusting the gap between the free end of bimetal 37 and protrusion 79 of trip member 76.

To reset cradle 50, handle 73 is moved to the left with respect to FIG. 1 together with pin 77 which extends through slot 82*a* in reset link 82 to pivotally connect link 82 to operating member 67. Outwardly projecting ear 83 of cradle wall 50*a* extends into slot-like window 82*b* of link 82 to operatively connect cradle 50 to member 67. Thus, as handle 73 moves to the left cradle 50 moves counterclockwise until latch tip 55 falls below latch 56. Subsequent movement of handle 73 to the right with respect to FIG. 1 moves the right end of spring 66 downward until its line of action is below pivots 52 at the right end of toggle 44, 47 at which point spring 66 moves toggle knee 46 downward. This extends toggle 44, 47 thereby moving contact 34 into engagement with contact 33. For manually opening, circuit breaker 25 handle 73 is moved to the left with respect to FIG. 1 and in so doing the right end of spring 66 is moved above pivots 52 at the right end of toggle 44, 47 so that the line of action of spring 66 is then directed to collapse toggle 44, 47 and separate movable contact 34 from stationary contact 33.

In addition to thermal trip means provided by bimetal 37, circuit breaker 25 also includes magnetic or instantaneous trip means comprising movable armature plate 86 and stationary U-shaped yoke 85 having arms between which bimetal 37 extends. The left or pivot edge of plate 86 is captured by cap member 87 and the right edge of plate 86 is biased upwardly by spring 88. When armature 86 is attracted to yoke 85 during occurrences of fault current in excess of a predetermined magnitude, armature 86 engages edge formation 89 on trip member 76 to pivot the latter counterclockwise. This draws link 75 downward to trip latch plate 64 and release cradle 50.

Figure 3A:
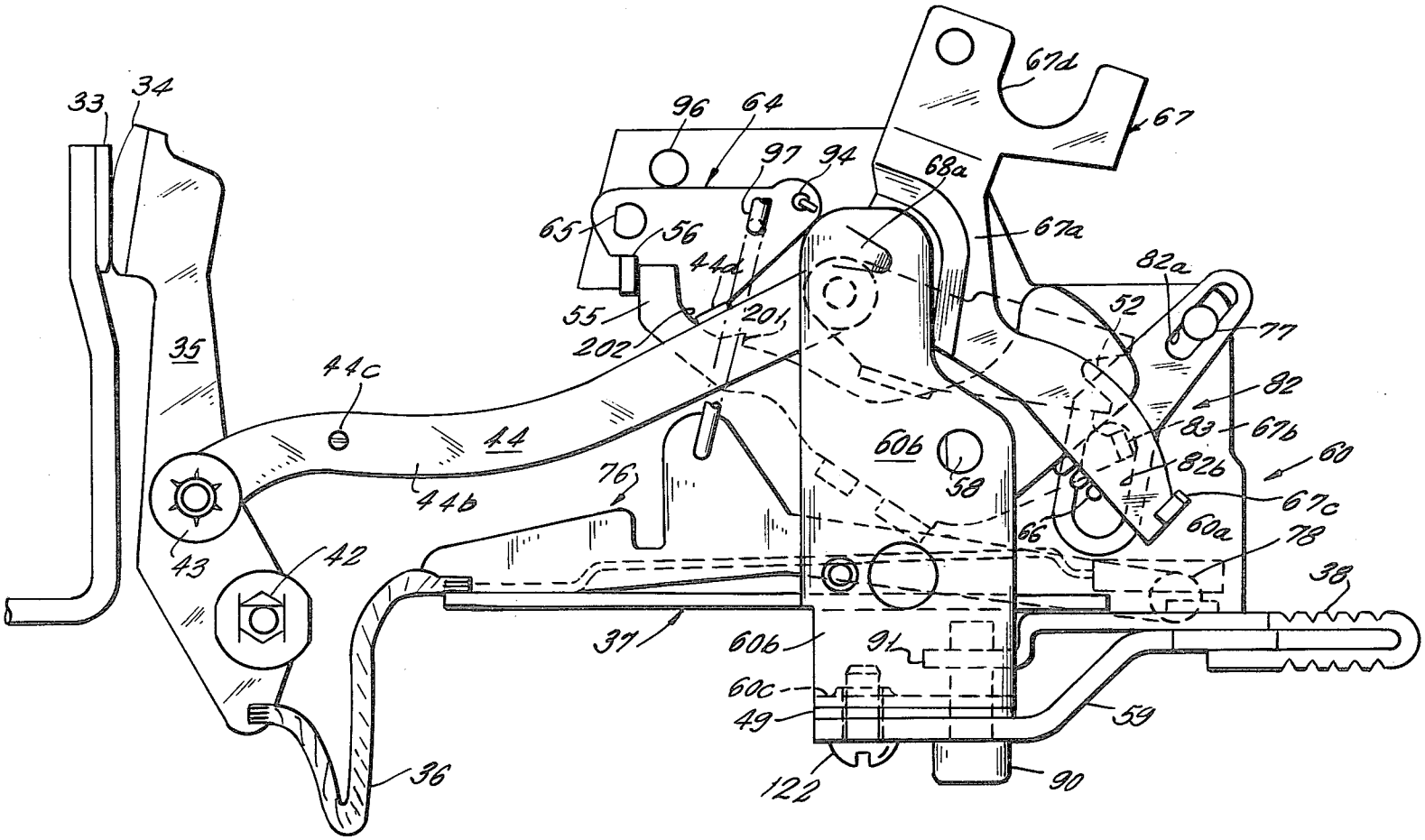
FIG. 3A is a side elevation of the contact operating mechanism as the elements thereof move toward tripped position with the contacts still engaged.
Figure 4:
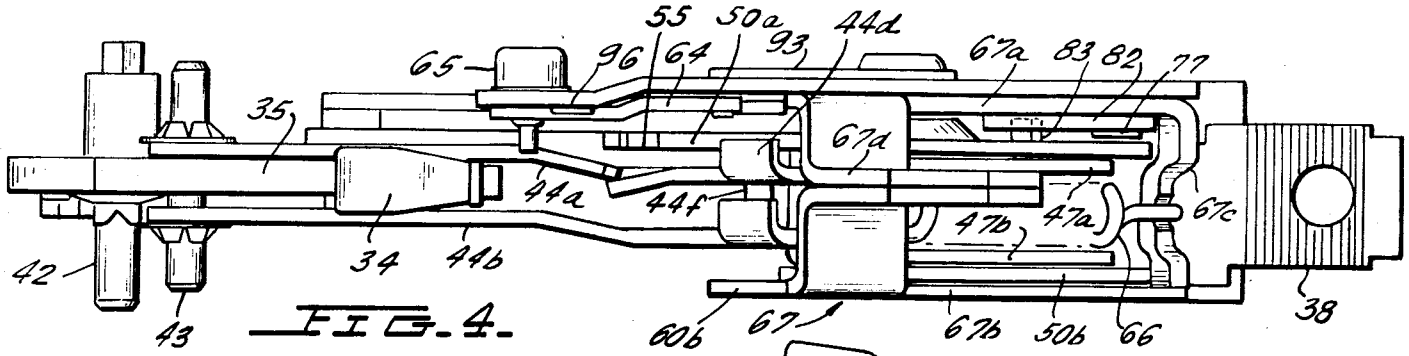
FIG. 4 is a plan view of the mechanism of FIG. 3A looking in the direction of arrows 4—4 of FIG. 3A.
Figure 3B:
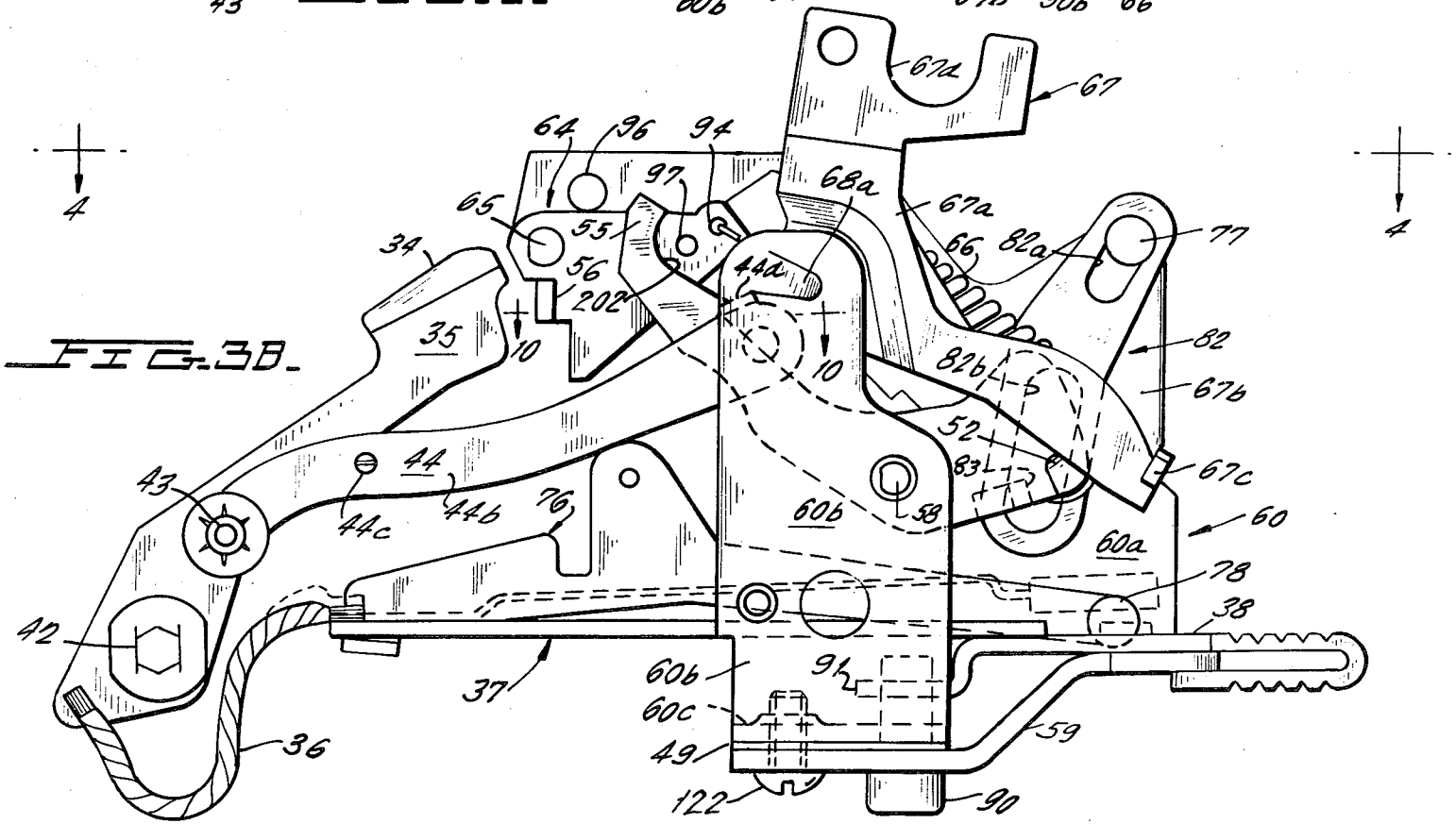
FIG. 3B shows the elements of FIG. 3A in full tripped position.

It is noted that when operating member 67 is pivoted from right to left with respect to FIG. 3*b* for resetting cradle 50, there is substantial upward movement of pin 77 which connects reset link 82 to operating member 67. Similarly, as cradle 50 is pivoted counterclockwise toward its reset position there is substantial upward movement of reset ear 83. The provision of reset link 82 substantially reduces friction forces operating between operating member 67 and cradle 50 during resetting of the latter. That is, during resetting, to a great extent link 82 moves upward to impart upward movement to reset ear 83. When movements of ear 83 and pivot pin 77 do not coincide, the pivotal mounting of reset link 82 acts to compensate for this effect without the necessity of overcoming large friction forces.

Figure 8:
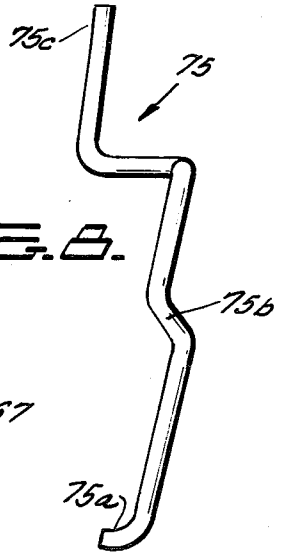
FIG. 8 is a side elevation looking in the direction of arrows 8—8 of FIG. 1 showing the formed wire link connecting the test button with the main latch of the contact operating mechanism.

Now referring more particularly to FIGS. 1 and 8, it is seen that wire link 75 is formed with offset 75*a* at its lower end to operatively engage trip member 76. At a point intermediate the ends thereof, link 75 operatively engages latch member 64 by means of offset section 75*b*.

The upper end 75c of link 75 extends into an aperture in the lower surface of plastic pushbutton 120 whose upper surface is accessible at the front of circuit breaker housing 26, 27 adjacent to aperture 74 through which manual operating handle 73 extends. Spring 93 biases latch member 64 in a counterclockwise direction with respect to FIG. 1. This biases link 75 upward to normally maintain the upper surface of pushbutton 120 essentially flush with the upper surface of circuit breaker housing 26, 27. By merely depressing button 120, link 75 is forced downward thereby pivoting latch member 64 clockwise to move to its tripped position for automatic opening of circuit breaker contacts 33, 34.

Circuit breaker 25 is provided with anti-rebound means to prevent movable contact 34 from bouncing back toward stationary contact 33 when cradle 50 moves to its tripped position. More particularly, this anti-rebound means includes notch or undercut 201 on latching tip extension 55 of cradle 50 which receives sideways protrusion 44d of toggle arm 44a when cradle 50 is in its fully tripped position and movable contact 34 is fully separated from stationary contact 33, as in FIG 3B.

A comparison of FIGS. 1, 3A and 3B shows how latching tip extension 55 of cradle 50 acts as both a contact kicker and an anti-rebound means. That is, in FIG. 1 circuit breaker contacts 33, 34 are closed and cradle 50 is latched. In FIG. 3A latch 56 has been moved to the left of cradle latch tip 55 so that cradle 50 begins to pivot clockwise toward trip position. During this motion, the curved upper edge 202 near the free end of extension 55 engages protrusion 44d of toggle arm 44a. The engagement between toggle edge 202 and protrusion 44d is a hammer-like blow which acts through toggle link 44 to kick contact arm 35 toward open circuit position.

As cradle 50 continues to pivot clockwise toward full trip position, toggle 44, 47 collapses and in so doing protrusion 44d moves into notch 201, as in FIG. 3B. Should contact arm 35 attempt to rebound from the full open position of FIG. 3B toward the contact closed position of FIG. 3A, protrusion 44d is constrained to move downward and toward the left with respect to FIG. 3B. However, this movement of protrusion 44d is blocked by cradle 50 in that protrusion 44d is disposed within notch 201. When cradle 50 is pivoted counterclockwise toward its reset position, protrusion 44d is released from notch 201 and contact arm 35 may then be operated toward closed circuit position.

In the embodiment of FIGS. 9 through 12 the anti-rebound means includes notch 301 on auxiliary extension 55a of cradle 350 which receives spacer 44f cradle 350 is in its fully tripped position and movable contact 34 is fully separated from stationary contact 33, as in FIG. 11. Extension 55a projects from cradle section 50b and is inwardly offset toward latching tip extension 55 (see FIGS. 9A and 12) and generally parallel thereto. Notch 301 is in the upper edge of extension 55a as is curved kicker formation 302. The latter is positioned closer to the free end of extension 55a than is notch 301.

A comparison of FIGS. 9, 10 and 11 shows how auxiliary extension 55 of cradle 350 acts as both a contact kicker and an anti-rebound means. That is, in FIG. 9 circuit breaker contacts 33, 34 are closed and cradle 350 is latched. In FIG. 10 latch 56 is moved to the left of cradle latch tip 55 so that cradle 350 begins to pivot clockwise toward trip position. During this motion the upper edge formation 302 engages spacer 44f with a hammer-like blow which acts through toggle link 44 to kick contact arm 35 toward open circuit position.

As cradle 350 continues to pivot clockwise toward full trip position, toggle 44, 47 collapses and in so doing spacer 44f moves into notch 301, as in FIG. 11. Should contact arm 35 attempt to rebound from the full open position of FIG. 11 toward the contact closed position of FIG. 9, spacer 44f is constrained to move downward and toward the left with respect to FIG. 11. However, this movement of spacer 44f is blocked by cradle 350 in that spacer 44f is disposed within notch 301. When cradle 350 is pivoted counterclockwise toward its reset position, spacer 44f is released from notch 301 and contact 35 may then be operated toward closed circuit position.

In the embodiment of FIGS. 13 through 16 the anti-rebound means includes notch 44h in the lower edge of toggle link 44b which receives tip 402 at the free end of cradle extension 401 when cradle 450 (FIG. 16) is in fully tripped position and movable contact 34 is fully separated from stationary contact 33, as in FIG. 15.

A comparison of FIGS. 13, 14 and 15 shows how auxiliary extension 401 acts as both a contact kicker and an anti-rebound means. That is, in FIG. 13 circuit breaker contacts 33, 34 are closed and cradle 450 is latched. In FIG. 14 latch 56 has been moved to the left of cradle latch 55 so that cradle 450 begins to pivot clockwise toward tripped position. During this motion, the free end 402 of extension 401 engages the lower edge of toggle arm 44b with a hammer-like blow which acts through toggle link 44 to kick contact arm 35 toward open circuit position.

As cradle 450 continues to pivot clockwise toward full trip position, toggle 44, 47 collapses and in so doing tip 402 moves into notch 44h, as in FIGS. 14 and 15. Should contact arm 35 attempt to rebound from the part or full open position of the respective FIGS. 14, 15, notch 44h is constrained to move downward and toward the left with respect to FIG. 15. However, this movement of notch 403 is blocked by tip 402 in that the latter is disposed within notch 403. When cradle 350 is pivoted counterclockwise toward reset position, tip 402 is released from notch 403 and contact arm 35 may then be operated toward closed circuit position.

It is noted that in each of the three anti-rebound means described, when the toggle is fully collapsed and the cradle is in tripped position, the cradle, one of the toggle links and part of the other toggle link are in a triangular arrangement which is extremely rigid in a direction for contact closing but does not interfere with resetting of the cradle.

Although there has been described preferred embodiments of this invention, many variations and modifications will now be apparent to those skilled in the art. Therefore, this invention is to be limited, not by the specific disclosure herein, but only by the appended claims.

What is claimed is:

1. A circuit breaker including separable cooperating contact means, an operating mechanism connected to a movable portion of said contact means for opening and closing same, said mechanism including a collapsible and extendable toggle, main spring means connected to said toggle for collapsing and extending same, a latchable cradle supporting said toggle to permit closing of said contact means when said cradle is latched, said cradle when unlatched being moved by said spring means to a trip position wherein said mechanism is incapable of closing said contact means, said toggle including first and second links joined to one another and to said spring means at a knee, said first link being connected to said movable portion of said contact means, said second link being pivotally connected to said cradle, said cradle including a first formation operatively positioned when said cradle is in said trip position to operatively engage a second formation on said first link to block movement thereof in a direction for closing said contact means.

2. A circuit breaker as set forth in claim 1 in which one of said first and second formations comprises a notch which receives the other of said first and second formations when said cradle is in said trip position to hold said toggle in collapsed condition.

3. A circuit breaker as set forth in claim 1 in which the second formation is a notch in said first link which receives said first formation when said cradle is in said trip position to hold said toggle in collapsed condition.

4. A circuit breaker as set forth in claim 3 in which the first formation operatively engages said first link when said contact means is closed and said cradle moves toward trip position to kick said toggle in contact means opening direction.

5. A circuit breaker as set forth in claim 4 in which the cradle includes a latching extension and an auxiliary extension, said first formation being at the free end of the auxiliary extension.

6. A circuit breaker as set forth in claim 1 in which the first link includes spaced arms, said second formation is positioned between said arms, and said first formation includes a notch in said cradle which receives said second formation when said cradle is in said trip position to hold said toggle in collapsed condition.

7. A circuit breaker as set forth in claim 6 in which the cradle also includes a section that operatively engages the second formation when said contact means is closed and said cradle moves toward trip position to kick said toggle in contact means opening direction, said first formation being on said section.

8. A circuit breaker as set forth in claim 7 in which the cradle includes a latching extension and an auxiliary extension, said auxiliary extension carrying both said notch and said section with the former being closer than the latter to a pivot on which said cradle is mounted.

9. A circuit breaker as set forth in claim 1 in which the first formation operatively engages said first link when said contact means is closed and said cradle moves toward trip position to kick said toggle in contact means opening direction.

10. A circuit breaker as set forth in claim 1 in which the cradle also includes a section that operatively engages the second formation when said contact means is closed and said cradle moves toward trip position to kick said toggle in contact means opening direction, said first formation being on said section.

11. A circuit breaker as set forth in claim 10 in which the cradle includes an extension having a latching portion at its free end, said extension carrying both said section and said first formation with the latter being further than the former from said free end.

12. A circuit breaker as set forth in claim 1 in which the second formation projects outboard of said first link and said first formation includes a notch in said cradle which receives said second formation when said cradle is in said trip position to hold said toggle in collapsed condition.

13. A circuit breaker as set forth in claim 12 in which the cradle engages the second formation when said contact means is closed and said cradle moves toward trip position to kick said toggle in contact means opening direction.

* * * * *